US005518040A

United States Patent [19]

Rupflin

[11] Patent Number: 5,518,040

[45] Date of Patent: May 21, 1996

[54] MECHANISM FOR SIMULTANEOUSLY COUPLING OR UNCOUPLING A PLURALITY OF HEALD SHAFT COUPLING DEVICES

[75] Inventor: Fritz Rupflin, Lindau, Germany

[73] Assignee: Lindauer Dornier Gesellschaft mbH, Lindau, Germany

[21] Appl. No.: 356,118

[22] Filed: Dec. 15, 1994

[30] Foreign Application Priority Data

Dec. 22, 1993 [DE] Germany ..... 43 43 882.2

[51] Int. Cl.[6] ..... D03C 9/00; D03C 1/14

[52] U.S. Cl. ..... 139/57; 403/325; 292/194; 292/341.17

[58] Field of Search ..... 292/131, 341.17, 292/194; 403/325; 139/57, 88, 83

[56] References Cited

U.S. PATENT DOCUMENTS 4,365,653 12/1982 Freisler et al. ..... 139/57
4,369,815 1/1983 Gehring et al. ..... 139/57
4,541,459 9/1985 Palau ..... 139/57
4,715,409 12/1987 Graf ..... 139/57
5,050,644 9/1991 Peter ..... 139/57

FOREIGN PATENT DOCUMENTS 0407335 12/1993 European Pat. Off. .

*Primary Examiner*—Andy Falik
*Attorney, Agent, or Firm*—W. G. Fasse; W. F. Fasse

[57] ABSTRACT

A coupling device for connecting a heald shaft to a heald drive such as a push-pull rod and for disconnecting the heald shaft from the heald drive such as a push-pull rod has a plug-in member connected to the heald shaft and a socket member connected to the heald drive. The socket member is equipped with a toggle mechanism for locking and unlocking a pawl that engages or disengages the plug-in member. The toggle mechanism is spring loaded so that a separate locking device is not necessary. A plurality of such coupling devices are arranged in groups for operation in unison by a drive mechanism that includes a cam drive for each coupling device. All the cam drives for a group of coupling devices are secured to a splined shaft for operation in unison so that all coupling devices can be coupled or decoupled simultaneously.

18 Claims, 3 Drawing Sheets

MECHANISM FOR SIMULTANEOUSLY COUPLING OR UNCOUPLING A PLURALITY OF HEALD SHAFT COUPLING DEVICES

FIELD OF THE INVENTION

The invention relates to a mechanism for simultaneously coupling or uncoupling a plurality of heald shaft coupling devices. A plurality of such mechanisms is used in a loom for connecting the heald shafts to respective heald drives. It is desirable to couple or decouple all heald shaft coupling devices in unison or simultaneously.

BACKGROUND INFORMATION

Conventional heald shaft couplings comprise one or several elements that form a first or shaft section of the coupling and one or more elements forming a second or drive section of the respective coupling. The sections engage each other in the coupled state in a positive manner also referred to as a "form-locking" manner which transmits the drive power between the corresponding heald shaft drive and the respective heald shaft.

Conventional heald shaft couplings require involved tools for the coupling and decoupling of the heald shafts from or with the respective heald drive. These tools are used to individually connect or disconnect each coupling which is very time consuming. As a result, the coupling of the harness with its many heald shafts to the shaft drives requires a substantial amount of time for a harness exchange.

Efforts have been made heretofore to reduce the time required for a harness exchange. Reference is made to European Patent Publication EP 0,407,335 (Peter) disclosing a loom with a tiltable operating tool for the heald shaft couplings. Such a tool enables the simultaneous connecting and disconnecting or opening and closing of a plurality of heald shaft couplings. The operation of the conventional tool requires two conditions that must be met. First, the heald shaft couplings require a special construction. Second, the heald shafts must first be brought into the so-called equal shaft position. The tool itself is fixed to the machine frame. The tool reaches around individual shaft couplings or around the total number of shaft couplings. After the tool has been adjusted by rotating the tool, a tension force is applied to the drive connected sections of the heald shaft couplings, whereby these couplings are simultaneously either coupled or decoupled.

Conventional heald shaft couplings of the type just described require a relatively large effort and expense, especially in their manufacture, because the drive sections and the shaft sections of a coupling have an involved geometric configuration as well as a multitude of cooperating surfaces for the transmission of tension and impact forces.

OBJECTS OF THE INVENTION

In view of the above it is the aim of the invention to achieve the following objects singly or in combination:

- to construct a heald shaft coupling so that its individual components have a simple geometric configuration to thereby reduce the effort and expense in their manufacture;

- to construct the coupling in such a way that it has an inherent locking characteristic to thereby avoid an additional locking or safety element as is required in the above mentioned prior art;
- to provide an operating mechanism for the simultaneous coupling and decoupling of a plurality of the couplings of loom heald shafts;
- to arrange the operating device outside of the movement range of the heald shafts and outside the movement of the heald drives; and
- to assure that the operating mechanism holds the shaft push-pull rod in a standby or waiting position that is required for the simultaneous coupling or the simultaneous decoupling operation when a harness exchange or shaft change is intended.

SUMMARY OF THE INVENTION

The above objects have been achieved according to the invention in that the present coupling device has a first or plug-in section that is connected to a heald shaft and a second or socket section that is connected to the respective shaft drive. The second or socket section has a journalled latching pawl that is operated into a coupling or a decoupling position by a toggle mechanism with a three-point link. The three-point link is pivoted or journalled at three points to the latching pawl, preferably at a point spaced from the journal of the latching pawl, to a tension spring, and to an operating member which in turn is journalled in the socket housing of the second or socket section of the coupling device. The operating member is preferably a bellcrank or angle lever having a first arm pivoted to the three-point link and a second arm forming an actuating arm. The bellcrank or angle lever is journalled in the socket housing. The actuating arm of the angle lever cooperates with an operating mechanism that is constructed to operate all actuating arms in unison for a simultaneous coupling or decoupling of a plurality of heald shafts. Preferably, the socket housing of the second coupling section is equipped with a guide member providing a guide surface extending in parallel to a longitudinal axis of the heald shaft coupling device and opposite to the locking pawl, whereby the guide surface and the locking pawl together form a guide funnel for the plug-in section of the present coupling device.

The most important advantages of the invention are seen in that the individual coupling elements of the first and second coupling sections have simple geometric configurations so that manufacturing is greatly simplified. Another advantage is seen in that a separate safety device for locking the coupling in one or the other position has been obviated by the use of a toggle actuating mechanism according to the invention. Further, the present coupling devices are well suited for being operated in unison for a simultaneous coupling and decoupling of all the heald shafts of a harness in unison, whereby an additional advantage is provided in that the present operating mechanism can be conveniently positioned outside of the motion range of the heald shafts and the shaft drives. This feature has the further advantage that the operating mechanism is not exposed to a zone within the loom in which fly lint is generated.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
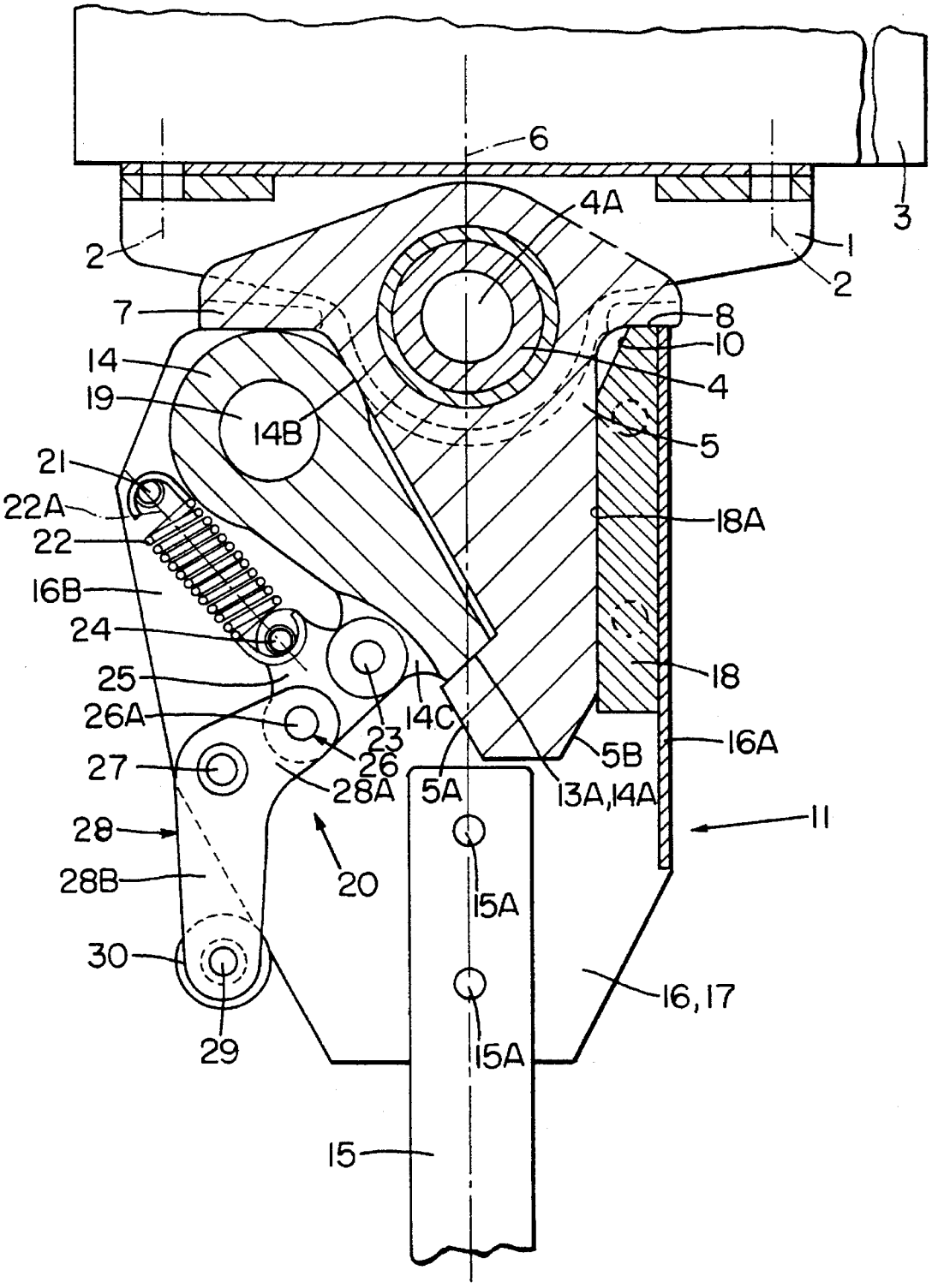
FIG. 1 is a sectional view through a coupling device according to the invention shown in its coupled state in which the first plug-in coupling section that is connected to a heald shaft is plugged into the second socket coupling section that is connected to a heald drive.

FIG. 1 shows a heald shaft 3 with a mounting bracket 1 attached to the lower end of the shaft 3 by screws 2. The coupling device according to the invention comprises a first plug-in section 5 also referred to as a shaft section because the first section 5 is connected to the heald shaft 3 by a journal 4 including a journal axis 4A passing through the mounting bracket 1. Thus, the plug-in coupling section 5 can tilt clockwise or counterclockwise around the journal axis 4A to a limited extent due to stop members 7 and 8 to be described in more detail below.

The present coupling device further comprises a second or socket section 11 including a socket housing formed by sidewalls 16 and 17 and an end wall 16A forming a box that is open at the top and the bottom and also on the left side at 16B. The box forming a socket housing is rigidly connected to a heald drive push-pull rod 15 by screws 15A or the like. Thus, the socket section 11 may also be referred to as the drive section of the present coupling device. Further, a guide block 18 having an inwardly facing guide surface 18A and a lead-in surface 10 is secured inside the socket housing 16, 17 next to the end wall 16A. The heald drive push-pull rod 15 is rigidly but releasably connected to the heald drive (not shown) by a bushing 15B and screws 15C.

Both coupling sections 5 and 11 have a common vertical axis 6 that passes centrally through the journal axis 4A and through the heald drive push-pull rod 15. The plug-in section 5 is constructed as a plug-in member having slanted end faces 5A and 5B that facilitate the insertion of the plug-in member into the socket housing 16, 17 of the second coupling section 11. Additionally, the plug-in member 5 has a right-hand guide surface 12 that cooperates with the guide surface 18A of the guide block 18. The plug-in member 5 has a further guide surface 13 opposite the guide surface 12 and a latch engaging or locking surface 13A as best seen in FIG. 2.

Figure 2:
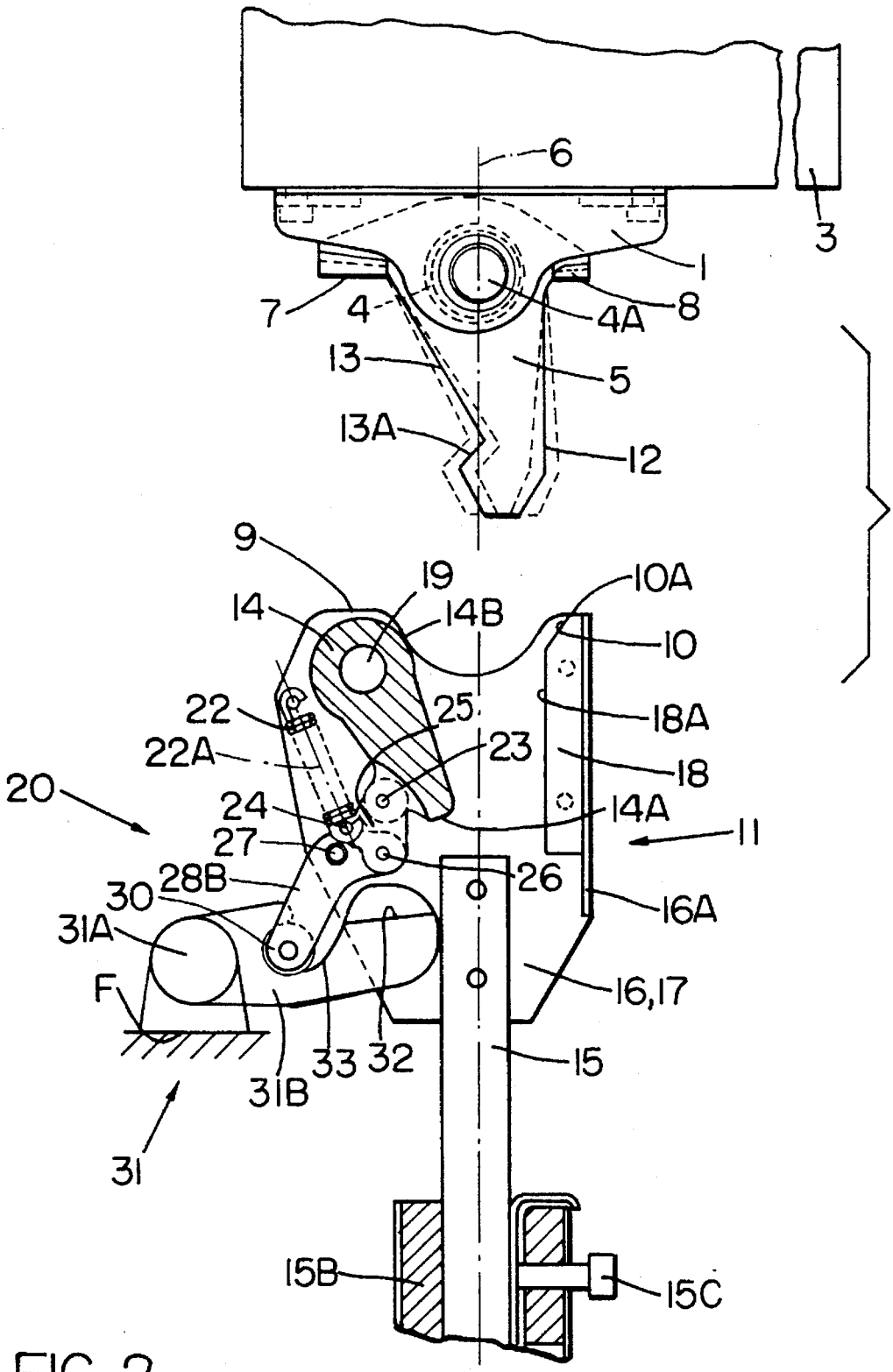
FIG. 2 shows a sectional view similar to that of FIG. 1, however illustrating the coupling device in its decoupled state and further showing an operating mechanism for the simultaneous coupling or decoupling of a plurality of the present coupling devices.

The dashed line positions of the plug-in member 5 shown in FIG. 2 illustrate the extent to which the plug-in member 5 is tiltable clockwise or counterclockwise about the journal axis 4A in accordance with the stop limits imposed by the downwardly facing surfaces of the stop members 7 and 8 when these members engage the top edges 9 and 10A of the socket housing 16, 17. Thus, when the stops 7 and 8 engage the edges 9 and 10A as shown in FIG. 1, the coupling device is fully engaged and further downward movement of the first coupling section 5 is prevented.

Referring to FIG. 2, the stop surface of the stop member 8 extends substantially horizontally when the plug-in member 5 is in the shown full line position while the guide surface 12 extends substantially vertically so that the surfaces 12 and the stop surface of the member 8 form substantially a right angle where these surfaces merge. The stop surface of the stop member 7 also extends horizontally in the full line position, and merges into the guide surface 13 that extends at an acute angle relative to the vertical axis 6 so that the angle between the stop surface of the member 7 and the guide surface 13 is larger than 90°. The guide surface 13 merges into the above mentioned latch engaging locking surface 13A that extends with a slant relative to the central axis 6. The angle between the surfaces 13 and 13A is slightly larger than 90°.

Referring to FIGS. 1 and 2, a latching pawl 14 of the second coupling section 11 is journalled on a journal shaft 19 in the socket housing 16, 17. The latching pawl 14 has a latching surface 14A that cooperates with the locking surface 13A of the plug-in coupling member 5 when the two sections 5 and 11 are in the coupled state shown in FIG. 1. The journal shaft 19 is connected to the socket housing walls 16 and 17. According to the invention the locking pawl 14 is operated by a toggle mechanism 20 supported between the two socket walls 16 and 17. The toggle in the form of mechanism 20 comprises a tension spring 22, a three-point link 25, preferably in the form of a plate lever, and an operating member 28. These three components 22, 25 and 28 are mounted as follows. The upper end of the spring 22 is movably secured to a fixed stud 21 connected to the walls 16 and 17 of the socket housing. The lower end of the spring 22 is movably connected to a journal stud 24 rigidly connected to the three-point link 25. The three-point link 25 is journalled at 23 to an extension 14C of the latching pawl 14. Preferably, the journal 19 and the journal 23 or rather the three-point link are spaced from each other for an optimal mechanical advantage. The three-point link 23 is further journalled at 26 on a journal axis 26A to one arm 28A of the operating member 28 which in turn is journalled on a journal shaft 27 in the socket housing 16, 17. The operating member 28 forms preferably an angle lever having one arm 28A journalled at 26 to the three-point link 25, and a free arm 28B carrying a roller 30 journalled on a journal shaft 29 for actuating the angle lever 28 as will be described in more detail below.

The above described three-point link 25 with the tension spring 22 and the operating lever 28 together form said toggle mechanism 20 which provides an inherent bi-stable locking function. For this purpose the journals 25 and 26 are positioned on a straight line that forms the base of a triangle, the apex of which is formed by the third journal or pivot 24 to which the lower end of the tension spring 22 is connected. The first locking position of the toggle mechanism 20 is shown in FIG. 1 in which the longitudinal axis 22A of the tension spring 22 extends perpendicularly to the base line of the triangle passing through the pivots or journals 23 and 26. When the other stable position is reached as shown in FIG. 2, the baseline extends vertically and the longitudinal axis 22A of the spring 22 extends at a slant to the baseline. This construction of the toggle mechanism 20 with its three-point link 25, which is preferably a plate, obviates the use of a separate locking mechanism which is an advantage of the invention.

In order to decouple sections 5 and 11 from each other to bring these sections from the position shown in FIG. 1 into the position shown in FIG. 2, the pawl 14 is moved clockwise by a force applied to the free end of the second arm 28A of the angle lever 28 through the roller 30, whereby this force causes the angle lever 28 to rotate clockwise, thereby bringing the three-point link 25 against the force of the spring 22 from the position of FIG. 1 into the position of FIG. 2.

Figure 3:
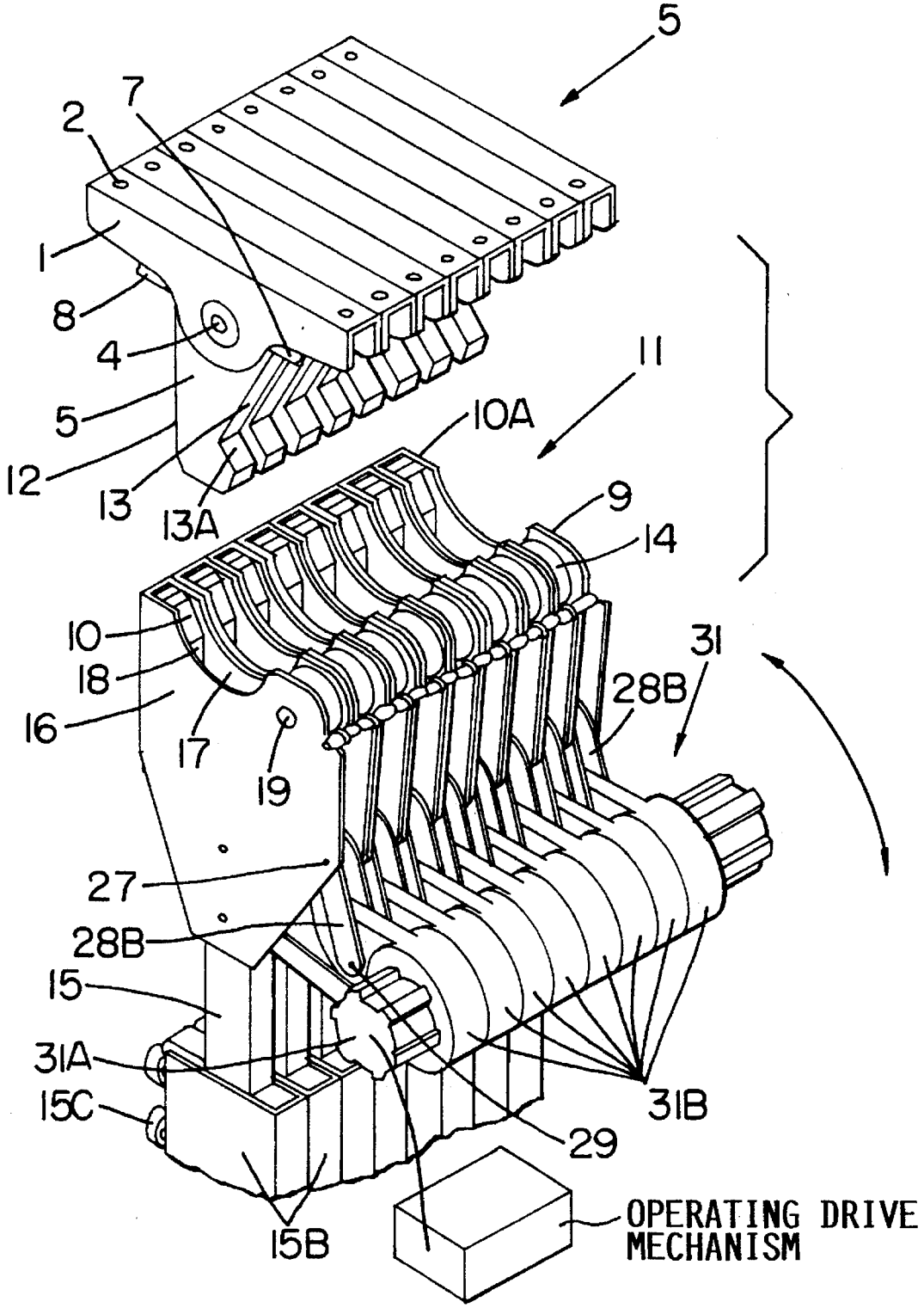
FIG. 3 shows a perspective view of a plurality of coupling devices illustrated in their decoupled condition and showing the operating mechanism for driving all coupling devices in unison.

Referring further to FIG. 2 the actuating angle lever 28 is driven by an operating mechanism 31 comprising a rotatable adjustment shaft 31A rotatably mounted in the machine frame F. Cam drive members 31B are rigidly secured to the adjustment shaft 31A for rotation with the adjustment shaft. For this purpose, the adjustment shaft 31A is preferably a splined shaft as shown in FIG. 3. All of the cam drives 31B are arranged in a row on the splined shaft 31A and thus rotate with the splined shaft either clockwise for coupling or counterclockwise for decoupling as viewed in FIG. 3. In order to properly guide the cam follower roller 30 into the cam curve 33, the cam drive 31B is provided with a contact surface 32. Due to the arrangement of all cam drives 31B on a common spline shaft 31A, all coupling devices are operated in unison. Accordingly, all heald shafts 3 are coupled or decoupled with the respective push-pull rod 15 in unison and simultaneously.

Referring further to FIG. 2, in the decoupled state, the cam follower roller 30 is firmly held in the bottom of the curved cam recess 33 to maintain the decoupled state, for example, during a heald shaft exchange or a harness exchange. The positive or form-locking connection between the roller 30 and the cam drive 31B is removed by tilting the cam drive 31B clockwise in FIG. 2, thereby forcing the arm 28B with its cam follower roller 30 in a counterclockwise direction out of the cam recess 33, whereby the toggle mechanism 20 with its three-point link 25 drives the pawl 14 back into the locking position of FIG. 1, provided that the plug-in member 5 has been inserted into the socket housing 16, 17.

The drive for the splined shaft 31A are conventional and hence only shown as a box in FIG. 3.

The perspective view of FIG. 3 illustrates the relationship of the plug-in coupling members 5 arranged in a group. Each plug-in member 5 is connected to its respective heald shaft not shown in FIG. 3. The socket housings 16, 17 of the second coupling sections 11 are also arranged in a group. The plug-in members 5 and the lower sections 11 are closely spaced to form a packet. The illustration of FIG. 3 corresponds to that of FIG. 2, namely the released condition. By rotating the splined shaft 31A of the drive 31 by the drive in the opening or closing directions, the coupling or decoupling will be accomplished as described above provided the plug-in members 5 are plugged into the sections 11. All couplings or decouplings take place simultaneously or in unison.

FIG. 3 further shows that each arm 28B of the actuating levers 28 is a twin arm having two arm sections with the roller 30 held between these two arm sections as shown in FIG. 2. The journal 27 passes through both arm sections.

FIG. 1 shows that the latching pawl 14 has a curved cam projection 14B that contacts the surface 13 of the plug-in member 5 on its way into the socket 16, 17, thereby reducing the contact surface area and thus the friction between these components 5 and 14. This feature also facilitates the engagement of the surfaces 13A, 14A with each other.

Although the invention has been described with reference to specific example embodiments, it will be appreciated that it is intended to cover all modifications and equivalents within the scope of the appended claims.

What is claimed is:

1. A mechanism for simultaneously coupling and uncoupling a plurality of heald shaft coupling devices to and from a heald shaft, comprising a coupling drive (27, 28), each of said coupling devices comprising a first coupling section (5) connectable to a heald shaft, a second coupling section (11) connectable to said coupling drive (27, 28), said first coupling section (5) comprising a plug-in member (13) including a locking surface (13A), said second coupling section comprising a socket housing (16, 17) for receiving said plug-in member (13), a first journal shaft (19) in said socket housing, a latching pawl (14) journalled to said first journal shaft (19) in said socket housing (16, 17), said latching pawl including a latching surface (14A) for engaging said locking surface (13A) of said plug-in member (13) when said plug-in member (13) is plugged into said socket housing (16, 17), a toggle mechanism (20), mounted in said socket housing (16, 17) and connected to said latching pawl (14) for moving said latching pawl (14) into an engaging and a disengaging position relative to said locking surface (13A) of said first coupling section (5), said toggle mechanism (20) comprising a tension spring (22) mounted in said socket housing (16, 17) and a three-point link (25), and wherein said coupling drive (27, 28) comprises a second journal shaft (27) mounted in said socket housing (16, 17) and an actuating member (28) journalled to said second journal shaft (27) in said socket housing, and wherein said three-point link (25) is pivoted to said latching pawl (14), to said tension spring (22), and to said actuating member (28).

2. The mechanism of claim 1, wherein said coupling drive (27, 28) further comprises an operating mechanism (31), and wherein said actuating member (28) for said three-point link is an angle lever (28) having a first arm (28A) pivoted (at 26) to said three-point link (25) and a second operating arm (28B) for cooperating with said operating mechanism (31).

3. The mechanism of claim 2, wherein said second arm (28B) of said angle lever (28) comprises a cam follower member (30) at the free end of said second arm (28B) for cooperating with said operating mechanism (31).

4. The mechanism of claim 2, wherein said operating arm (28B) comprises a free end and a cam follower (30) rotatably secured at said free end, said operating mechanism (31) comprising an adjustment drive shaft (31A), a plurality of cam drives (31B) rigidly connected to said adjustment drive shaft (31A) for rotation with said adjustment drive shaft (31A), said cam followers (30) being positioned for cooperating with said cam drives (31B) for moving said operating arm (28B) of said angle lever (28) between a coupling position and a decoupling position.

5. The mechanism of claim 4, wherein said adjustment drive shaft (31A) extends alongside a plurality of heald shafts (3) in a direction cross-wise to a stroke movement of said heald shafts.

6. The mechanism of claim 4, wherein each of said cam drives comprises a cam curve (33) and wherein each of said cam followers comprises a cam follower roller (30) for engaging said cam curve (33).

7. The mechanism of claim 6, wherein said cam curve (33) is a curved recess into which said follower roller (30) can dip for a force transmitting engagement between said follower roller (30) and said curved recess.

8. The mechanism of claim 1, wherein said socket housing comprises a guide member (18) opposite said latching pawl (14), said guide member (18) having a guide surface (18A) extending in parallel to a longitudinal axis of said coupling device for guiding said plug-in member of said first coupling section (5) into said socket housing (16, 17).

9. The mechanism of claim 8, wherein said latching pawl (14) extends at a slant relative to said longitudinal axis of said coupling device to form with said parallel guide surface a guide channel into said socket housing (16, 17).

10. The mechanism of claim 1, wherein said latching pawl (14) has a curved surface (14B) projecting out of said pawl (14) for guiding said plug-in member of said first coupling section (5) into said socket housing (16, 17), whereby surface contact and friction between said plug-in member (5) and said latching pawl (14) is reduced and the engagement of said locking surface (13A) with said latching surface (14A) is facilitated.

11. The mechanism of claim 10, wherein said plug-in member of said first coupling section (5) comprises a detent forming said locking surface (13A) and a contact surface (13) for engaging said curved surface (14B) of said pawl (14), said plug-in member comprising, opposite said detent, a guide surface (12) for cooperating with said socket housing.

12. The mechanism of claim 1, wherein said plug-in member (5) of said first coupling section comprises lead-in surfaces (5A, 5B) at its free end.

13. The mechanism of claim 1, wherein said tension spring (22) of said toggle mechanism (20) is tiltably mounted to flip and flop between bi-stable positions.

14. The mechanism of claim 1, further comprising a mounting bracket (1) for connection to said heald shaft (3), a third journal shaft (4A) in said mounting bracket for journalling said plug-in member of said first coupling section (5) to said mounting bracket (1).

15. The mechanism of claim 1, wherein said three-point link (25) comprises a plate (25) having three pivots (23, 24, 26) positioned at corners of a triangle and connected to said tension spring (22), to said latching pawl (14), and to said actuating member (28) respectively, and wherein said pivot (23) connected to said latching pawl (14) and said pivot (26) connected to said actuating member (28) are positioned on a straight line forming the base of said triangle.

16. The mechanism of claim 15, wherein said pivot (24) connected to said tension spring (22) is positioned on said plate on a longitudinal axis (22A) of said tension spring (22), said longitudinal tension spring axis (22A) extending perpendicularly to said base of said triangle when said toggle mechanism (20) is in a coupling position (FIG. 1), said longitudinal tension spring axis (22A) extending at a slant to said base of said triangle when said toggle mechanism (20) is in a decoupling position (FIG. 2).

17. The mechanism device of claim 2, further comprising a push-pull rod (15) rigidly connected to said socket housing (16, 17) and a connector (15B, 15C) for rigidly but releasably connecting said push-pull rod (15).

18. The mechanism of claim 1, wherein said latching pawl (14) has a curved projection (14) for guiding said plug-in member (5) into said socket housing.

* * * * *